US007708241B2

(12) United States Patent
Wiemholt

(10) Patent No.: US 7,708,241 B2
(45) Date of Patent: May 4, 2010

(54) WINE DECANTING APPLIANCE AND METHOD FOR DECANTING

(76) Inventor: Steve D. Wiemholt, 21000 SW. McCormick Hill Rd., Hillsboro, OR (US) 97123

( * ) Notice: Subject to any disclaimer, the term of this patent is extended or adjusted under 35 U.S.C. 154(b) by 795 days.

(21) Appl. No.: 11/371,700

(22) Filed: Mar. 8, 2006

(65) Prior Publication Data

US 2007/0210109 A1 Sep. 13, 2007

(51) Int. Cl.
*A47F 5/12* (2006.01)

(52) U.S. Cl. ..... 248/138; 248/133; 222/166

(58) Field of Classification Search ..... D7/621; 248/133, 138, 142, 103, 105, 106, 313, 316.1, 248/316.4; 222/108, 164, 166, 180; 211/74
See application file for complete search history.

(56) References Cited

U.S. PATENT DOCUMENTS 1,249,341 A * 12/1917 Cropsey ..... 248/139
1,624,695 A * 4/1927 Tufenkjian ..... 248/103
3,868,047 A 2/1975 Bersano
D257,935 S * 1/1981 Allan ..... D7/621
D261,345 S * 10/1981 Koeppel et al. ..... D7/621
D262,085 S * 12/1981 Petley ..... D7/621
4,317,551 A 3/1982 Bishop
4,836,476 A * 6/1989 Wolf ..... 248/146
5,026,480 A 6/1991 Fischer
6,425,421 B1 7/2002 Morrison
6,568,660 B1 5/2003 Flanbaum

* cited by examiner

*Primary Examiner*—Gwendolyn Baxter
(74) *Attorney, Agent, or Firm*—Jason Aldred

(57) ABSTRACT

A decanting apparatus for wine and the like and method of use thereof wherein a source vessel is compressed within a cradle having an open end where the lip of the mouth of the source vessel communicates with the lip of a decanting receptacle. A pair of adjustable vertical support members are hinged to the open end of the cradle. The apparatus has a drive mechanism for tilting the vessel relative to the vertical support members and a control unit for operatively controlling the means for tilting, allowing for an unattended decanting operation.

15 Claims, 5 Drawing Sheets

WINE DECANTING APPLIANCE AND METHOD FOR DECANTING

FIELD OF THE INVENTION

The present invention relates to apparatuses for decanting liquid from one container to another, and particularly pertains to a wine decanting apparatus and method thereof which provide for an automatic tilting actuation.

BACKGROUND OF THE INVENTION

Traditionally, wine has been decanted before serving to separate the wine from its sediment. Older, heavy-bodied wines accumulate sediment during the aging process. This sediment when mixed with the wine can cause the wine to have a bitter, astringent flavor.

Decanting wine also causes the wine to mix with oxygen. Younger wines often come to life when aerated. The mixture of the wine with oxygen allows the wine to develop, improving its subtlety and complexity. Thus, a younger wine's flavor can become enhanced with aeration.

Proper decanting requires a slow, steady flow to prevent turbulence which will stir up the sediment, clouding the wine. Achieving this slow, steady flow is a skill, requiring patience and attention often left to a Sommelier in a busy restaurant or wine tasting room. An improperly decanted wine may be distasteful or unfit for the level of quality expected and thus wasted. Wine connoisseurs typically understand and appreciate the need for decanting, as well as the interval of time required to properly decant. When preparing to enjoy an expensive wine that has been purchased and aged specifically for an occasion, the decanting is as much a part of the ceremony as is the libation itself.

The use of filters, pumps, and tubing alleviate the need for a server to pour the bottle and maintain the mouth of the bottle in a proper position relative to the mouth of the decanting receptacle, allowing even the unskilled to decant properly. In addition, filters, pumps, and tubing reduce the interval of time required to decant. However, filters, pumps, and tubing in contact with wine are anathema to most fine wine enthusiasts.

A number of products have been developed in an attempt to decant wine. One known product and accompanying method for decanting wine is disclosed in U.S. Pat. No. 6,425,421 issued to Morrison on Jul. 30, 2002. Morrison's apparatus includes a pump unit and a fluid withdrawal unit. Also, included is a support unit that is dimensioned to receive a wine bottle in a tilted orientation with the upper portion of the wine bottle at an angle of inclination such that the sediment tends to collect at the lowest point within the peripheral well of the wine bottle. In Morrison's disclosure, the wine is siphoned out of the bottle into a decanting receptacle and the sediment is shifted to a concentrated location away from the fluid withdrawal unit. As such, Morrison's apparatus and method for decanting wine removes almost the entire fluid volume of a bottle of fine vintage wine, while employing the use of a filter, a pump, and tubing.

U.S. Pat. No. 5,026,480 issued to Fischer on Jun. 25, 1991 discloses a decanting apparatus that attempts to automatically transfer the flowable contents of one vessel into another vessel within a short interval of time. Fischer's apparatus includes a carrier in the form of a cradle or balance beam that rocks back and forth in response to the flow of red wine from a wine bottle on one arm of the carrier into a decanting receptacle on the other arm of the carrier. The disclosure also incorporates a candle for illuminating the transfer so that a server can observe the quantity of flowable substance and prevent residue or sediment from being transferred. In Fischer's disclosure, the server nearly empties the entire fluid contents of the first vessel by manually tilting the carrier beyond its further point of inclination while attempting to ensure that no sediment is transferred with the fluid contents of the first vessel into the second vessel.

Reference can also be made to U.S. Pat. No. 3,868,047 issued on Feb. 25, 1975 to Bersano. In Bersano's disclosure, the wine bottle is supported by a cradle that is pivotally attached to a frame. Shafts rotatably support both the frame and the bottle and provide a point of pivot at a location along the length of the cradle's longitudinal axis. A means for gradually tilting the wine bottle is provided so that a server can manually turn a crank to bring the bottle into its wine pouring position. Throughout the cranking operation and resultant tilting maneuver, the server positions a receiving receptacle to receive the wine by engaging the receiving receptacle to the mouth of the wine bottle. With the pivot point located along the length of the cradle's longitudinal axis, the neck and mouth of the bottle are forced in a downward direction during the cranking operation. U.S. Pat. No. 3,868,047 further discloses a means for projecting a beam of light through the neck of the wine bottle so that the server can observe if sediment is being poured with the wine during the decanting operation.

Accordingly, there exists a need for an apparatus for decanting wine which controls the rate of pour of the wine and the tilt of the wine bottle in a manner which leaves the sediment in the bottle without requiring skill and constant attention from the server. Such an apparatus must be of relatively straightforward, compact design and construction to maximize its automatic operation, while employing a precise pour to transfer nearly the entire fluid content of the bottle. The wine bottle must be positioned and steadied during the tilting actuation so that in its final position of inclination the sediment remains in the bottle. The decanting operation must be achieved hands-free, without having to attend to the receiving receptacle and the repositioning thereof, as the wine is poured from the bottle into the receiving receptacle. Inasmuch as the art is relatively crowded with respect to various types of wine decanting apparatuses, it can be appreciated that there is a continuing need for and interest in improvements to such apparatuses, and in this respect, the present invention addresses the need and interest. None of the known disclosures are believed to detract from the described and claimed embodiments of the present invention.

SUMMARY OF THE INVENTION

The present invention is a decanting apparatus for wine and the like and method of use thereof. The decanting apparatus is a cradle having an open end where the lip of the mouth of the source vessel communicates with the lip of a decanting receptacle. The open end of the cradle is connected to a closed-walled rearward end by a pair of elongate side rails. Fastened to the closed-walled rearward end is a spring-loaded tensioner for supporting the base of a source vessel with liquid therein. The neck and shoulder portions of the source vessel are supported by an adjustable positioner. The source vessel is compressed between the adjustable positioner and the spring-loaded tensioner. A pair of adjustable vertical support members bilaterally hinged to the side rails at the open end of the cradle provide vertical support for the apparatus. The source vessel is suspended at an angle such that the lip of the mouth of the source vessel contacts the lip of the decanting receptacle. The apparatus has a means for tilting the vessel relative to the vertical support members and a means for operatively controlling the means for tilting.

BRIEF DESCRIPTION OF THE DRAWINGS

The accompanying drawings, which are incorporated into and constitute a part of this specification, illustrate one or more embodiments of the present invention and, together with the detailed description, serve to explain the principles and implementations of the invention.

DETAILED DESCRIPTION

Figure 1:
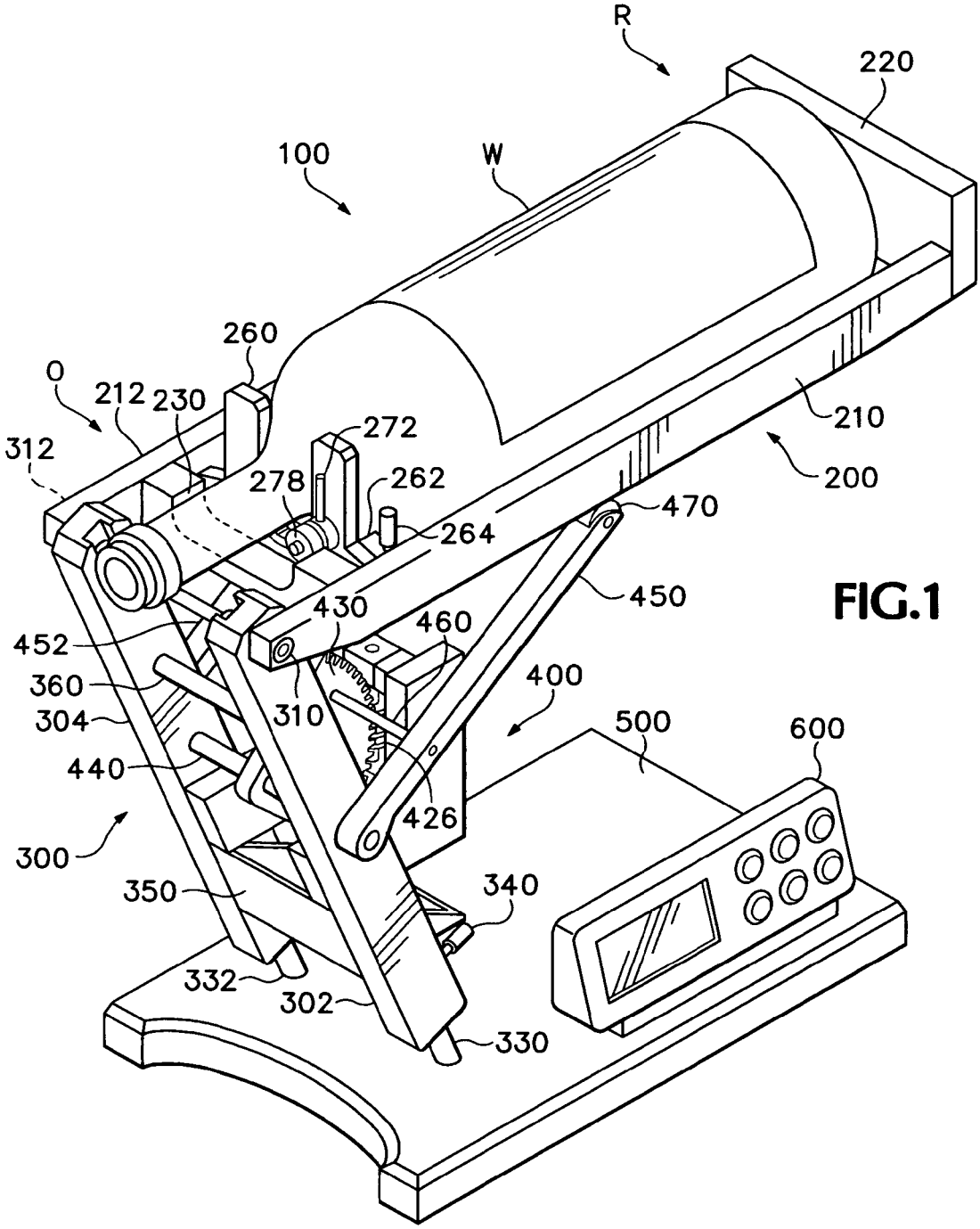
FIG. 1 is an isometric view of the invented wine decanting appliance in accordance with one embodiment of the invention.

Referring to the drawings, wherein like reference numerals represent like parts throughout the various drawing figures, reference numeral 100 is directed to a wine decanting appliance.

In essence and with particular reference to FIG. 1, a wine decanting appliance 100 is shown for providing automatically controlled and unattended transfer of the fluid contents of a source vessel W into a receiving receptacle, also known as a decanting receptacle D while leaving the lees, sediment or solid matter pooled in the wells and in the shoulder of the source vessel W. In general, the source vessel W is any conventionally sized bottle for storing and aging wine having a known expanded mouth ring, preferably 750 mL sized. It will be understood by those skilled in the art that appliance 100 can be constructed to accommodate 375 mL, 1.5 L or any other size wine bottles W typically known in the art. The appliance 100 has a cradle 200 for supporting the bottle W, a pair of columns 300 bilaterally hinged to the cradle 200, a drive mechanism 400 for providing the means for tilting, a base plate 500, and a programmable control unit 600.

More specifically, and with particular reference to FIGS. 1-6, details of the cradle 200 are described. The cradle 200 supports and secures the bottle W throughout the tilting actuation. In one embodiment of the invention, cradle 200 has an open end O connected to a closed-walled 220 rearward end R by a pair of side rails 210, 212. Side rails 210, 212 are elongate support members that extend adjacent to the length of the bottle W on oppositely disposed sides of the bottle W. At rearward end R, the side rails 210, 212 bilaterally connect to the closed wall 220.

Figure 2:
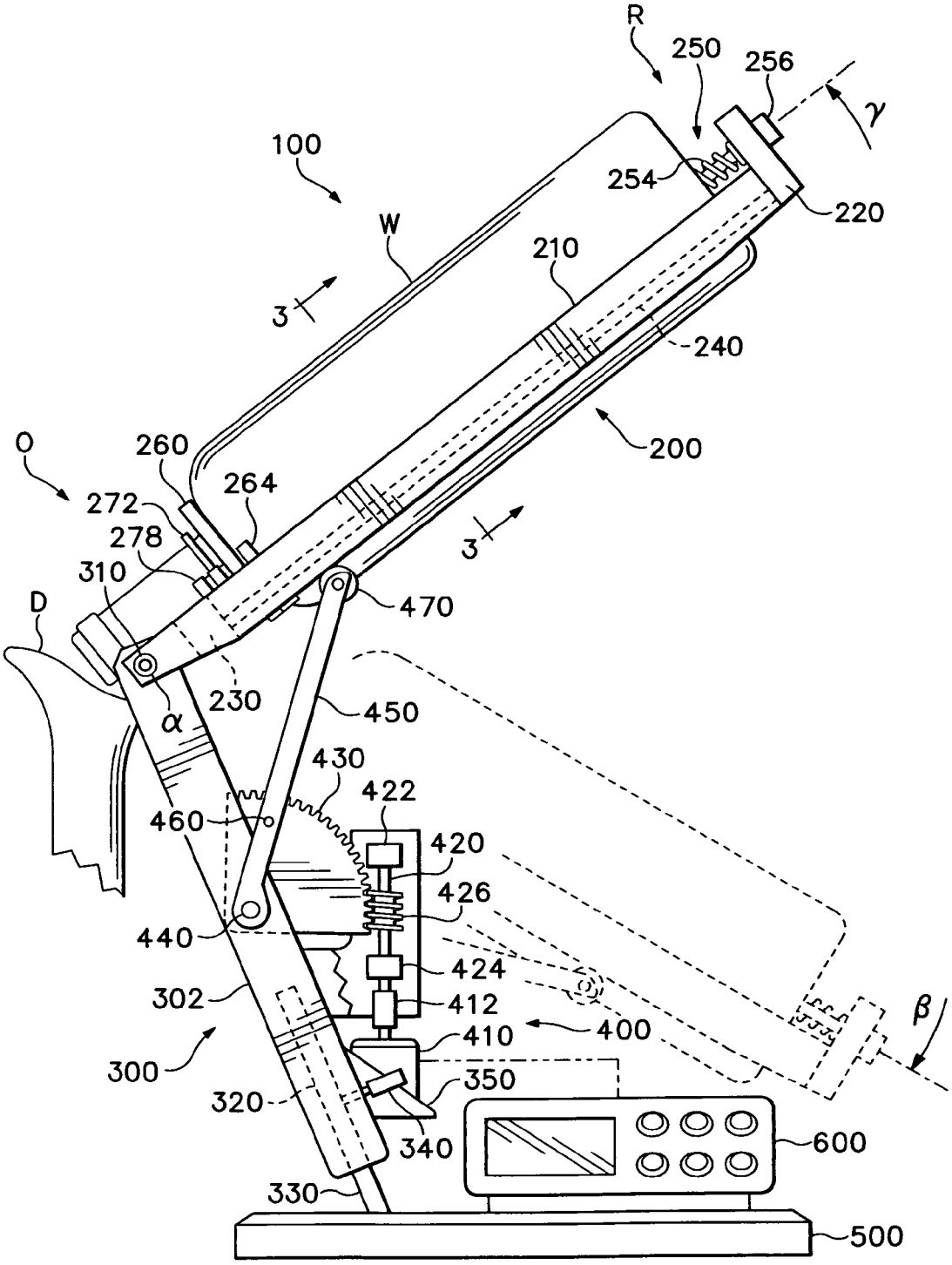
FIG. 2 is a side elevation view of the invented wine decanting appliance corresponding to FIG. 1.
Figure 5:
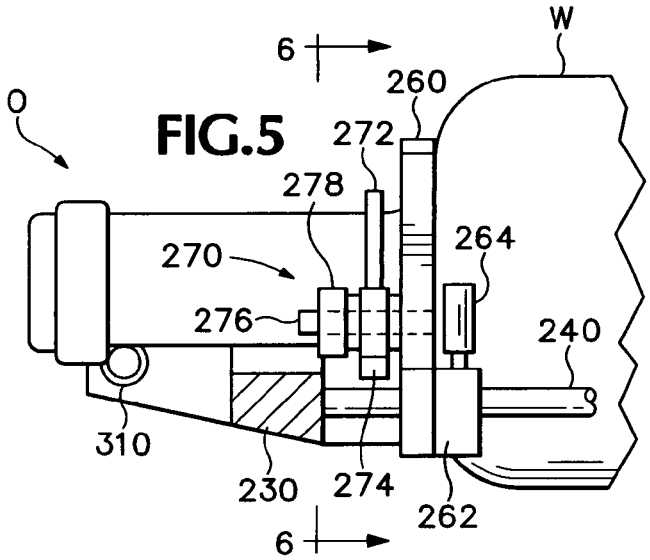
FIG. 5 is fragmentary, side elevation view featuring the adjustable front fork of the invented wine decanting appliance.

At open end O, the side rails 210, 212 are spanned by a bridge 230 which serves to secure the side rails 210, 212 one 210 to the other 212, as shown in FIGS. 1, 2 and 5. The upwardly facing planar side of the bridge 230 is recessed to provide clearance for the mouth and neck of the bottle W.

Figure 3:
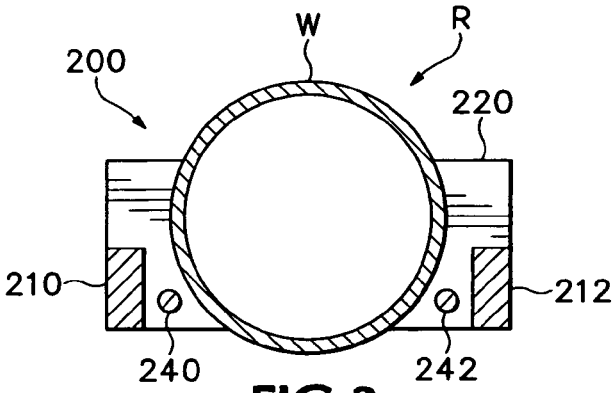
FIG. 3 is a fragmentary, side elevation view of the cradle of the invented wine decanting appliance corresponding to FIG. 2.
Figure 4:
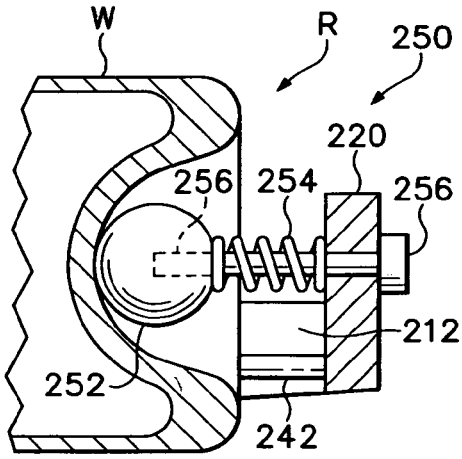
FIG. 4 is a fragmentary, side elevation view of the spring-loaded knob of the invented wine decanting appliance.

As shown in FIG. 2 (broken lines), and FIG. 4, a pair of cradle rods 240, 242 extend parallel to each inward side or bottle-side of the side rails 210, 212. Cradle rods 240, 242 serve as guides for front fork 260 as the front fork 260 slides along the lengths of the rods 240, 242 relative to spring-loaded knob 250. FIGS. 2 and 3, show the cradle rods 240 (broken lines), 242 attached to the closed wall 220 of the cradle 200 at rearward end R and to the bridge 230. As detailed in FIG. 5, the cradle rods 240, 242 are received through apertures in the flanged portions of the front fork 260. A piece of silk, decorated cloth or other suitable material can be draped over the cradle rods 240, 242 to span the cradle 200 and further support the wine bottle W, serving as an undercarriage.

With continuing reference to FIG. 2 and FIG. 4, spring-loaded knob 250 is fastened to the closed wall 220 at rearward end R. The spring-loaded knob 250 is a tensioner for providing a loading force to compress the bottle W between the front fork 260 and the spring-loaded knob 250. In a preferred embodiment, the spring-loaded tensioner 250 has a knob 252, a spring 254, and a tensioner shaft 256. The knob 252 is shaped to engage the dimple, also known as the "punt," in the base of a typical wine bottle W. As shown in FIG. 4, tensioner shaft 256 is secured into the knob 252, supporting the knob 252, and is encircled by the spring 254 to allow pistonic motion of the knob 252. It is also conceivable that other suitable spring-loaded tensioners, or the like could be used to provide the loading force.

In alternative embodiments, knob 252 can have a different shape, i.e., hemisphere, flattened, or oblong.

Figure 6:
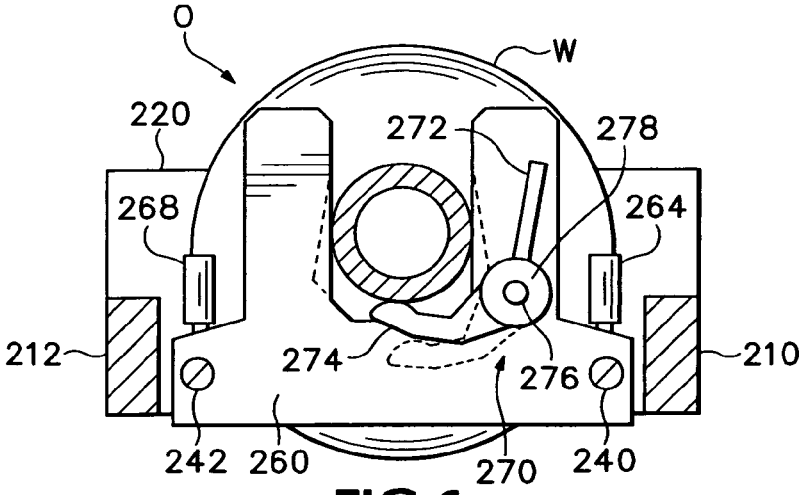
FIG. 6 is a fragmentary, side elevation view of the invented wine decanting appliance corresponding to FIG. 5.

FIGS. 1, 2 and 5, 6 show the front fork 260 in the presently preferred embodiment. The front fork 260 is an adjustable positioner that is slidably connected to the spring-loaded knob 250 via the cradle rods 240, 242 such that the bottle W is compressed between the front fork 260 and the spring-loaded knob 250 FIG. 6 shows the front fork 260 having a pair of laterally disposed flanged portions stemming off each of a pair of upright tines. The front fork 260 has an aperture in each flanged portion for receiving a cradle rod 240, 242 each therein, and guided via bushing block 262 and bushing block 266 (not shown but implied). The front fork 260 is adjustably slidable along the lengths of rods 240, 242. The bottle W is positioned in the cradle 200 by loading the base of the bottle W onto the spring-loaded knob 250, lowering the neck of bottle W between the tines of the front fork 260, then sliding the front fork 260 rearward along the length of the cradle rods 240, 242, thereby compressing the bottle W between the front fork 260 and the spring-loaded knob 250. To hold the compressed bottle W in place, thumbscrews 264 and 268 are used. The inner and rearward surfaces of the tines of the front fork 260 are chamfered to provide compound angle surfaces for securing and centering the neck and shoulders of the bottle W and to further prevent the bottle W from slipping out of the front fork 260 during the tilting actuation.

With continuing reference to FIGS. 1, 2 and 5, 6, the fine height adjust or 270 is used to bring the lip of the wine bottle W into alignment with tilt axis $\alpha$, ensuring that the lip of the bottle W properly communicates with and engages the decanting receptacle D. As detailed in FIGS. 5 and 6, the fine height adjustor 270 is fastened to the front face of the front fork 260. Fine height adjustor 270 is an upright handle 272, a thumb portion 274, a threaded rod 276, and a thumbnut 278. By manually moving the handle 272 in a direction away from the neck of the bottle W, the thumb portion 274 is caused to raise the neck of the bottle W and bring the lip of the bottle W into alignment with the tilt axis $\alpha$. Once properly aligned, thumbnut 278 is used to lock the fine height adjustor 270 and secure the bottle W in position. It is conceivable that other conventionally known levers, cams, rockers, or the like can be used as a fine height adjustor 270.

Referring to FIGS. 1 and 2, the wine decanting appliance 100 further preferably includes dual spaced-apart columns 300 (pair). The columns 300 are adjustable vertical support members of suitable length to provide a height sufficient to allow the lip of the mouth of the bottle W to communicate with the lip of the decanting receptacle D so that the wine can be transferred from the bottle W into the decanting receptacle D. The columns 302, 304 are spaced apart to provide a width that corresponds to the space between the side rails 210, 212 and the open end O of the cradle 200. The columns 302, 304 are also inclined, as shown in FIGS. 1 and 2. Columns 300 are inclined at an angle of greater than 90 degrees relative to the base plate 500 (to be described below) or generally horizontal support surface. As a result, the columns 300 do not interfere with decanters D having a bulbous bottom while the lip of the decanter D and the lip of the mouth of the bottle W are aligned with the tilt axis α. The columns 302, 304 are bilaterally hinged to the side rails 210, 212 with tilt axis pins 310, 312. Each column 302, 304 has a bore 320, 322 in the bottom portion thereof to receive support shafts 330, 332 (not shown but implied) for providing additional adjustability in height to engage the decanting receptacle D. The columns 302, 304 can be adjusted vertically on the support shafts 330, 332, raising or lowering the cradle 200 to position the tilt axis α at the corresponding height of the lip of decanter D. Once the proper height is achieved the columns 300 are secured in place via thumbscrew 340 and thumbscrew 342 (not shown but implied).

In another embodiment, the columns 300 can be configured with an offset or jog to further accommodate wide-bottom decanting receptacles D.

Columns 300 further include bearings which receive tilt axis pins 310, 312 that project inward at open end O from each side rail 210, 212, as shown in FIGS. 1, 2 and 5. The pins 310, 312 hinge each side rail 210, 212 to each column 302, 304 on the top portions of each column 302, 304. Each side rail 210, 212 and each respective column 302, 304 are manufactured to receive each pin 310, 312 therein. The tilt axis pins 310, 312 are rigidly secured to the side rails 210, 212, and rotate freely in the tilt axis bearings of columns 300. The tilt axis pins 310, 312 are conventionally known and suitable for the hinge-tilt movement of the cradle 200 relative to the columns 300.

Referring to FIG. 1, lower brace 350 spans the space between the pair of columns 300. In a preferred embodiment, lower brace 350 includes a recessed area for receiving a motor 410, to be described herein.

Figure 8:
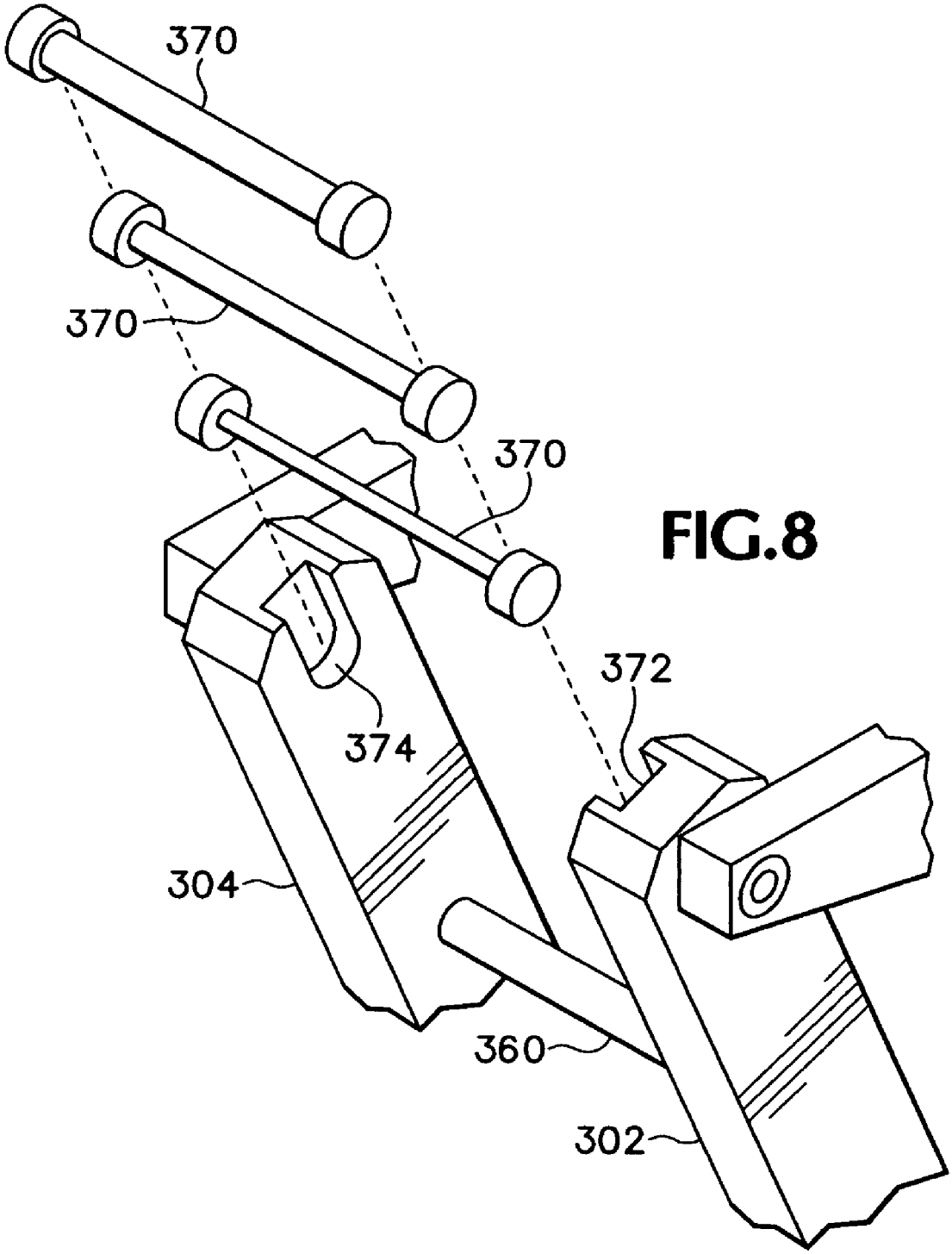
FIG. 8 is a fragmentary, isometric view of the invented wine decanting appliance featuring the alignment rod.

As detailed in FIG. 1 and FIG. 8, cross brace 360 spans the space between the pair of columns 300 above brace 350 relative to the position of the brace 350 along the length of the vertically disposed columns 300. The cross brace 360 provides further rigid support for the appliance 100. In a preferred embodiment, a plurality of cross braces can be spaced apart down the length of the columns 300.

Referring to FIG. 8, removable alignment rod 370 facilitates dribble-free pours by aiding the server in sighting the lip of the bottle W with the tilt axis α. The removable alignment rod 370 is roughly dumb-bell shaped, having a central cylindrical section capped on each end. The central cylindrical section of the alignment rod 370 can be manufactured to come in different sized diameters to approximate the diameters of the lips of different sized decanting receptacles D. FIG. 8 shows three alignment rods 370 with differently sized diameters. The lip of the mouth of the bottle W is meant to overhang the alignment rod 370 with the diameter that most closely matches the diameter of the lip of the desired decanting receptacle D. The ends of alignment rod 370 are adapted to be received in channels 372, 374 located in the columns 300. The lip to rod 370 contact simulates the eventual lip to lip contact necessary for achieving alignment with the tilt axis α. Once properly sighted the rod 370 is removed and replaced by the decanting receptacle D, thus preventing spillage of wine during the decanting operation and allowing unattended operation. It is conceivable that other conventionally known laser and other sighting mechanisms or the like could be used as a removable alignment rod 270.

As shown in FIGS. 1 and 2, the drive mechanism 400 of the appliance 100 provides a means for tilting the cradle 200, thereby transferring the contents of the wine bottle W into the decanting receptacle D. The drive mechanism 400 includes a suitable motor 410 and coupler 412 with a worm shaft 420 secured between bearings 422, 424. The motor 410, coupler 412, worm shaft 420, and bearings 422, 424 can be contained in any typically known and suitably sized and shaped journal-box, housing, or container. In a preferred embodiment, a worm 426 is mounted on the worm shaft 420. The worm 426 drivingly engages the teeth of a worm gear 430 which then rotatably engages lift arms 450, 452 via lift shaft 460. Worm gear 430 has a hole located at its effective rotation axis, to receive rotation shaft 440 therethrough. Rotation shaft 440 is rotatably coupled to each lift arm 450, 452 by being received through each column 302, 304. The lift arms 450, 452 are connected at the rotation shaft 440 which extends through each column 302, 304 and in contact with each side rail 210, 212 via roller bearings 470. Roller bearings 470 are suited for rolling along a shallow recessed bearing race in the underside of each side rail 210, 212. Roller bearing 470 is shown in FIGS. 1 and 2 attached to end of lift arm 450. Not shown is a roller bearing attached to the second lift arm 452. It is conceivable that other suitable bearings could be used to slide or roll on each side rail 210, 212. As the lift arms 450, 452 are driven in an upward direction, the mouth of the bottle W is operatively tilted about the tilt axis α having a starting pour angle β and ending at the maximum pour angle γ. Propulsion of the cradle, and thus the bottle, through the range of tilt is provided by the drive mechanism 400. The mechanical tilt range is approximately 65.5 degrees, ranging from a negative angle of approximately −28 degrees β to a maximum angle of approximately 37.5 degrees γ. The angles for which the pouring of the wine will start and end are within this mechanical tilt range and can be set programmatically. Tilt angle zero corresponds to the position where the wine bottle W is horizontal, or parallel to the base plate 500. The lip of the mouth of the wine bottle W, maintains a substantially steady position, communicating with lip of the decanting receptacle D throughout the tilting actuation. It is conceivable that hydraulic or pneumatic forces, as well as other known lifts, winches/pulleys, lead screws, jacks, hoists, and cams could be used as the means for tilting.

In an alternative embodiment, a counter weight can be used with the drive mechanism 400. The counter weight reduces the load on the appliance 100, enables the use of smaller motors, and reduces power requirements.

FIGS. 1 and 2, show a base plate 500 connected to the columns 300 of the decanting appliance 100. The base plate 500 provides stability for support on a horizontal surface. The bottom portions of the columns 300 are support shafts 330, 332 adapted to be rigidly secured to the base plate 500. The base plate 500 has a scalloped recess at one end to provide clearance for the bulbous bottom of some decanter D designs.

If portability is no longer desired, support shafts 330, 332 can be secured directly into a commercial-setting fixture having a planar surface such as a counter top, table top, or bar, alleviating the need for the base plate 500 such that the support shafts 330, 332 can be received directly into the fixture.

With continuing reference to FIGS. 1 and 2, the decanting appliance 100 includes a control unit 600. The control unit 600 is a means for operatively controlling the drive mechanism 400. Control unit 600 is attached to the base plate 500 and operatively connected to the drive mechanism 400. In alternate embodiments, programming and or activation (i.e. issuance of Start Tilt command) of the control unit 600 may be accomplished by, but not limited to, RF wireless control link, IrDA link, RC5 remote control link, hardwired RS-232 or USB or other serial link, between the control unit 600 and a laptop computer, desktop computer, PDA, standard infrared remote control, or custom RF or infrared remote control.

Figure 7:
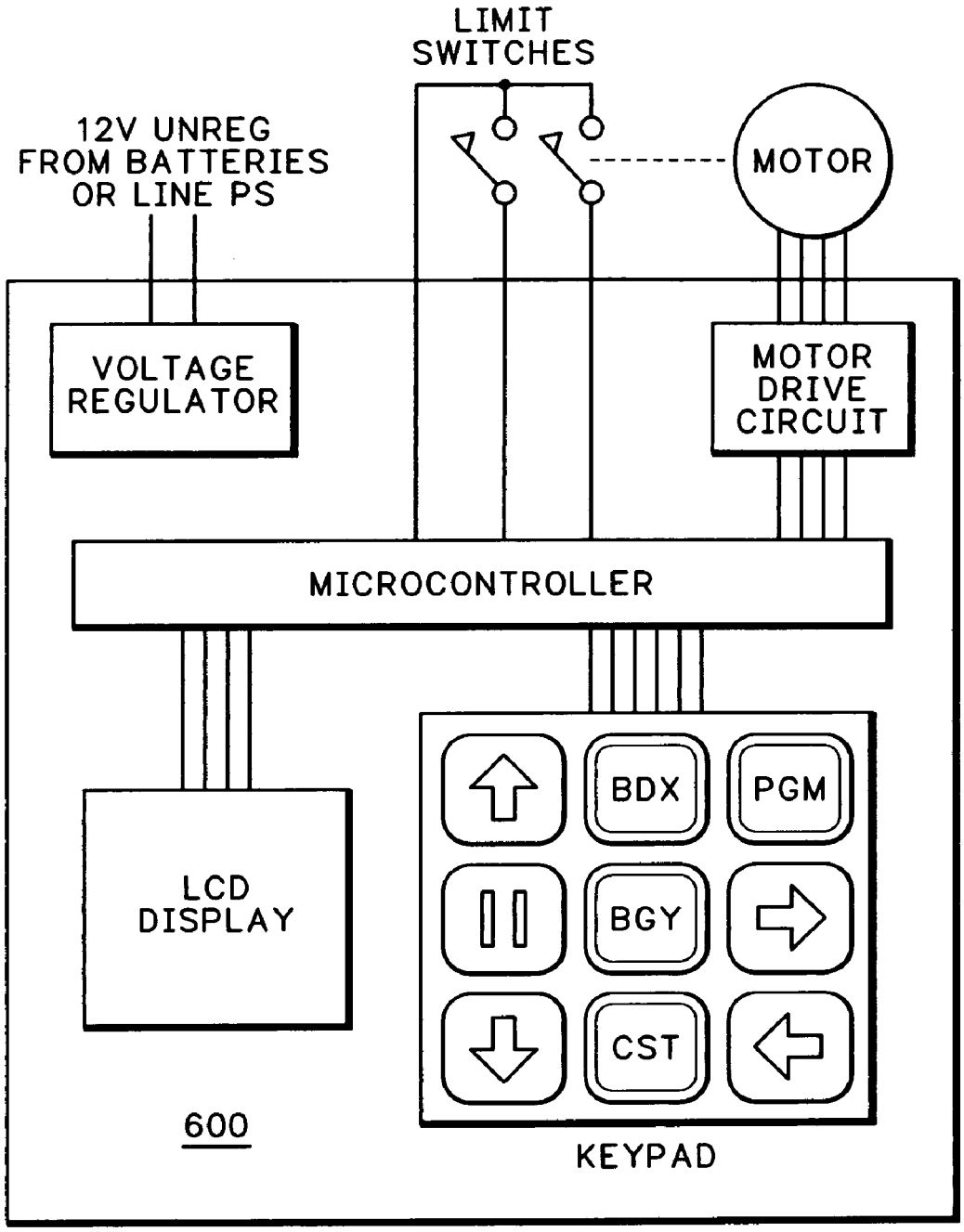
FIG. 7 is a diagrammatic view featuring the control unit of the invented wine decanting appliance.

As detailed in FIG. 7, control unit 600 outputs a motor drive signal to the drive mechanism 400 for the operation of the motor 410. In the preferred embodiment, the motor 410 and motor control circuit are of the stepper motor type. This motor type has the advantage that it may be operated open loop (without position feedback), reducing cost and complexity, and yet maintain good position control accuracy. In alternate embodiments other motor types may be employed, and rotary encoder feedback may be used for position feedback to obtain closed loop control of the drive mechanism 400. The motor drive circuit is controlled by the microcontroller of control unit 600. The microcontroller receives upper and lower limit switch inputs from the drive assembly 400 and reacts to these inputs by halting the drive signals to the motor control circuit for the current direction of travel. As the tilt actuation proceeds, there is a nonlinear relation between angular displacement of the lift arms 450, 452 and that of the cradle 200, i.e., the change of angle of the cradle 200 is exponentially dependent upon the current angular position of the lift arms 450, 452. If desired, this nonlinear relation can be compensated for by varying the step rate of the stepper motor 410 over the course of the tilt actuation. The variation of the step rate can be achieved if the microcontroller generates step rate compensation values. The resulting tilt rate of the cradle 200 will thus be nearly constant throughout the tilt actuation. In addition, if desired, the rate of tilt can be slowed below the rates required for a linear tilt rate during the last few degrees of the tilt actuation. This will result in the slowest tilt rate near the end of the tilt actuation, thus further reducing the likelihood of lees being swept into the liquid flow and leaving the source vessel W.

In one embodiment, the control unit 600 includes a keypad and LCD display to allow the server to selectively set the desired tilt rate (or time to complete tilt actuation) and maximum angle of tilt $\gamma$ before the tilt actuation is started, as well as allowing the start, pause, stop, and reverse of the tilt actuation. The LCD display of the control unit 600 can provide information regarding appliance status, mode, tilt actuation progress, and user input prompts. The keypad of control unit 600 can further provide one-touch settings for decanting from a specific bottle type such as a setting for Burgundy (keypad button labeled BGY) and a setting for Bordeaux (keypad button labeled BDX). By pressing one of these one-touch buttons during preparation for the decanting operation, the pre-set tilt rate and maximum tilt angle $\gamma$ for that type of bottle W is activated. A third bottle type button, e.g., labeled CST, can be provided to allow pre-sets to be defined for a bottle W type of the server's choosing. These one-touch buttons ensure that bottle W is tilted at the ideal rate and limit the tilt angle for each bottle W type such that the sediment remains on the walls, or pooled in the shoulder of the bottle W at the end of the tilt actuation. It is conceivable that other configurations of the control unit, designs in input/output signals, digital and analog electronics and infrared or RF wireless remote controls could be used as the means for operatively controlling the appliance 100.

The wine decanting appliance 100 is typically powered by a universal AC line voltage to DC power supply (100-240VAC input/12VDC output) which connects to the control unit 600. Also, in another embodiment, typical rechargeable batteries can be used to power the appliance 100 should line voltage be interrupted, or unavailable. When connected to AC line voltage, the batteries are recharged, and maintained in a charged state by means of a battery charger circuit within control unit 600. The batteries may be mounted in a suitable housing secured to base plate 500. An electrical cable between the batteries and the control unit 600 provides power to the appliance 100. In another embodiment, provision could be made for use of non-rechargable batteries.

In operation in one embodiment, a liquid is decanted by an automatic, controlled and unattended transfer of the fluid contents of a source vessel W into a decanting receptacle D while leaving the lees, sediment or solid matter pooled in the wells and on the shoulder of the source vessel W. Before loading of the source vessel W into the cradle 200, the cradle 200 is set to the starting pour angle $\beta$ by pressing the down arrow key of the keypad of control unit 600. An open or unopened wine bottle W is loaded into the cradle 200 base end first by placing the punt of the bottle W onto the spring-loaded knob 250, then lowering the neck of the bottle W between the tines of the adjustable front fork 260. The front fork 260 is then slid rearward along cradle rods 240, 242 to load the spring-loaded knob 250. Once the bottle W is securely compressed between the front fork 260 and the spring-loaded knob 250, the bottle W can be secured in place with thumbscrew 264 and then opened if not already. Next, a removable alignment rod 370 with a width that most closely matches the width of the lip of the desired decanting receptacle D in which the wine is to be poured is selected to sight the lip of the bottle W with the lip of the decanting receptacle D. The selected alignment rod is installed 370 between columns 302, 304, using channels 372, 374. Thumbscrews 264 and 268 are loosened to allow movement of the front fork 260. The front fork 260 is adjusted forward or backward along cradle rods 240, 242. Thumbnut 278 is loosened to allow movement of fine height adjustor handle 272. The fine height adjustor handle 272 is adjusted so that the expanded mouth ring of bottle the W overhangs the removable alignment rod 370. Once the proper overhang of the expanded mouth ring of the bottle W to the removable alignment rod 370 is achieved the thumbscrews 264, 268 and thumbnut 278 are tightened. Then, removable alignment rod 370 is removed.

The height of the pair of vertical support members 300 is adjusted until the lip of the expanded mouth ring of bottle W just overhangs the lip of decanter D. Thumbscrew 340 and thumbscrew 342 (not shown but implied) are loosened to adjust columns 300 up or down along support shafts 330, 332 within bores 320, 322 until the lip to lip contact is achieved. Decanting receptacle D is positioned between columns 302, 304 and the height of the columns 300 is further adjusted until the lip of the expanded mouth ring of bottle W just overhangs and makes contact with the lip of the decanting receptacle D. Thumbscrews 340, 342 (not shown but implied) are then tightened to secure the columns 300 in place. With the above alignments having been accomplished, no further alignment checks or adjustments will have to be made if the shape of future bottles is not changed.

The control unit 600 is programmed to control the tilting actuation. The server can choose the bottle type option which most closely matches the actual bottle W to be decanted. The CST key will be chosen by the server when it is known that this key has been custom programmed (by the appliance 100 server/user) for the specific bottle type to be decanted. In one embodiment, these one-touch keys can recall and make active the pre-programmed settings such as Maximum Positive Tilt Limit, and Tilt Rate for the selected bottle type. These settings are optimized for the specific bottle W types, but may be altered by the server, or appliance 100 user.

The decanting operation is commenced by pressing the up arrow on the control unit 600. Once the tilting actuation is underway the server may pause, reverse, or resume the tilt actuation via inputs to keypad of control unit 600. In one embodiment, the PGM key of the keypad of control unit 600 can be used to enter programming mode. Access can be password protected if necessary. In another embodiment, a custom function can be set which makes the PGM key a quick access key to allow all users to quickly adjust Time To Decant for the bottle W type currently selected.

During the operation of the decanting operation the server is free to leave the appliance 100 unattended. Upon the completion of the tilting actuation, the wine is ready to be consumed.

It is further intended that any other embodiments of the present invention that result from any changes in application or method of use or operation, method of manufacture, shape, size, or material which are not specified within the detailed written description or illustrations contained herein yet are considered apparent or obvious to one skilled in the art are within the scope of the present invention.

Accordingly, while the present invention has been shown and described with reference to the foregoing embodiments of the invented apparatus, it will be apparent to those skilled in the art that other changes in form and detail may be made therein without departing from the spirit and scope of the invention as defined in the appended claims.

What is claimed is:

1. A wine decanting apparatus, comprising:

a cradle having a closed wall at the rearward end, a pair of bilaterally disposed elongate side rails, and an open end; said cradle enabling the lip of the mouth of a bottle cradled therein to communicate with the lip of a decanting receptacle positioned on a generally horizontal support surface;

a pair of columns bilaterally hinged to the side rails of said cradle at the open end of said cradle;

a means for tilting said cradle relative to said pair of columns; said tilting means driving the rearward end of said cradle upwardly while maintaining the position of the mouth of the bottle adjacent to and in pouring alignment with the lip of the decanting receptacle positioned on the support surface; and, a control unit operatively connected to said means for tilting.

2. The apparatus of claim 1, wherein said cradle further comprises:

a bridge with the upwardly facing planar side recessed for clearance of the mouth and neck of the bottle, said bridge connected to the pair of side rails proximate to the open end of said cradle such that said bridge spans the space between the pair of side rails away from the mouth of the bottle;

a spring-loaded knob for loading the base of the bottle into the rearward end of said cradle, said spring-loaded knob fastened to the closed wall at the rearward end;

a pair of cradle rods; each said rod extending inwardly parallel and adjacent to the length of each side rail between said bridge and the closed wall at the rearward end;

a front fork having a pair of upright tines and a pair of laterally disposed flanged portions with apertures for receiving said cradle rods therethrough, said front fork adapted to be slidably positionable relative to said spring-loaded knob along the length of each said cradle rod.

3. The apparatus of claim 2, wherein the upright tines of said front fork are chamfered for holding the neck and shoulder portions of the bottle.

4. The apparatus of claim 2, wherein an upright handle portion connected to a thumb portion is fastened to the front face of said front fork, such that when the handle portion is manually directed away from the neck of the bottle, the thumb portion upwardly engages the neck of the bottle from an underneath direction, further aligning the mouth of the bottle with the lip of the decanting receptacle.

5. The apparatus of claim 2, wherein the bottle is compressed between said front fork and said spring-loaded knob.

6. The apparatus of claim 1, wherein said columns are vertically adjustable to a height sufficient to allow the mouth of the bottle to communicate with the decanting receptacle.

7. The apparatus of claim 1, wherein the bottom portions of said columns are attached to a base plate, said base plate adapted to stabilize the apparatus on the generally horizontal surface.

8. The apparatus of claim 1, wherein the bottom portions of said columns are fastened directly into the generally horizontal surface, such that the bottom portions of said columns are adapted to be received therein.

9. The apparatus of claim 1, wherein said columns are inclined at an obtuse angle greater than 90 degrees relative to said base plate.

10. The apparatus of claim 1, wherein said columns are inclined at an obtuse angle greater than 90 degrees relative to the generally horizontal surface.

11. The apparatus of claim 1, wherein said means for tilting is a drive mechanism having a stepper motor and roller bearings adapted to roll along the bottom surface of the side rails of said cradle, driving the rearward end of said cradle upwardly.

12. The apparatus of claim 1, wherein said control unit is arrayed for at least the selection of starting, pausing, and reversing the tilt actuation.

13. The apparatus of claim 1, wherein a removably attachable alignment rod simulates the eventual lip to lip contact necessary for achieving alignment with the tilt axis.

14. A method for decanting a liquid from a source vessel to a decanting receptacle comprising the steps of:

introducing a source vessel into a cradle;

loading the base of the source vessel onto a spring-loaded tensioner and the neck and shoulder portions of the source vessel on an adjustable positioner;

sliding said adjustable positioner in a rearward direction along the length of the vessel;

compressing the vessel between said spring-loaded tensioner and said adjustable positioner;

sighting the lip of the source vessel with the lip of the decanting receptacle;

aligning the lip of the source vessel with the lip of the decanting receptacle;

adjusting the height of a pair of vertical support members such that the lip of the source vessel communicates with the lip of the decanting receptacle;

selecting a desired pour rate;

tilting said cradle relative to said pair of vertical support members; and, controlling said pour rate thereby decanting the liquid from the source vessel into the decanting receptacle.

15. A decanting apparatus, comprising:

a cradle having an open end connected to a closed-walled rearward end by a pair of side rails;

a spring-loaded tensioner for supporting the base of a source vessel with liquid therein, said spring-loaded tensioner fastened to the closed-walled rearward end of said cradle;

an adjustable positioner for supporting the neck and shoulder portions of the source vessel, said adjustable positioner connected to said spring-loaded tensioner such that the source vessel is compressed between said positioner and said tensioner;

a pair of vertically adjustable vertical support members bilaterally hinged to the side rails at the open end of said cradle such that the lip of the mouth of the source vessel contacts the lip of a decanting receptacle, said pair of vertical support members are disposed proximate to said adjustable positioner but spaced from said spring-loaded tensioner such that the source vessel is suspended at an angle relative to said vertical support members;

a means for tilting the vessel relative to said vertical support members; and, a means for operatively controlling said means for tilting, said means for operatively controlling arrayed for at least the selection of starting, pausing, and reversing the tilt actuation.

* * * * *